US007934960B1

(12) United States Patent
Zhang et al.

(10) Patent No.: US 7,934,960 B1
(45) Date of Patent: May 3, 2011

(54) POWER JACK CONNECTOR

(75) Inventors: Hvai-Dong Zhang, Taipei (TW); Mei-Chuan Yang, Taipei (TW); Ning-Lang Cheng, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/642,769

(22) Filed: Dec. 19, 2009

(51) Int. Cl.
*H01R 24/04* (2006.01)

(52) U.S. Cl. ..... 439/668; 439/669

(58) Field of Classification Search ..... 439/63, 439/79, 92, 95, 108, 581, 586, 607.01, 607.35, 439/668, 669, 939
See application file for complete search history.

(56) References Cited

U.S. PATENT DOCUMENTS 4,842,555 A * 6/1989 Cosmos et al. ..... 439/607.17
5,622,523 A * 4/1997 Kan et al. ..... 439/607.37
6,109,966 A * 8/2000 Chiou ..... 439/607.03
6,322,397 B1 * 11/2001 Zhang ..... 439/668
6,932,614 B1 * 8/2005 Kan ..... 439/580
6,994,564 B1 * 2/2006 Kan ..... 439/63
7,108,514 B2 * 9/2006 Chen et al. ..... 439/63
7,785,119 B1 * 8/2010 Chiang ..... 439/188

* cited by examiner

*Primary Examiner* — Thanh-Tam T Le

(57) ABSTRACT

A power jack connector for receiving a power plug connector has an insulating housing, a middle pin, a first shell surrounding a rear end of the insulating housing and a second shell having a supporting plate for covering the rear surface of the insulating housing and being connected with the first shell. The insulating housing defines a chamber passing through a front surface and a rear surface thereof for receiving the power plug connector. The middle pin has an inserting portion inserted into the chamber for contacting the power plug connector and a connecting portion. The first shell has a soldering portion for being connected to ground. A middle of the supporting plate defines a window. A plurality of contacting pieces at intervals are extended towards one side from an edge of the window and extended into the chamber for abutting against the power plug connector.

11 Claims, 4 Drawing Sheets

POWER JACK CONNECTOR

BACKGROUND OF THE INVENTION

1. Field of the Invention

The present invention generally relates to an electrical connector, and more particularly to a power jack connector.

2. The Related Art

In general, a power jack connector is set on an electronic product for transmitting power to the electronic product by mating with a power plug connector. A conventional power jack connector includes an insulating housing and a plurality of terminals disposed in the insulating housing and electrically connected with the power plug connector. However, some electromagnetic interference signals are inevitably generated when the power jack connector transmits signal to cause some noises and make the signal transmitted unstable. The above-mentioned power jack connector has no function of shielding electromagnetic interference. Therefore, a power jack connector capable of shielding electromagnetic interference is required.

SUMMARY OF THE INVENTION

An object of the present invention is to provide a power jack connector for receiving a power plug connector. The power jack connector has an insulating housing, a middle pin, a first shell surrounding a rear end of the insulating housing and a second shell. The insulating housing defines a chamber passing through a front surface and a rear surface thereof along the inserting direction of the power plug connector for receiving the power plug connector from a rear thereof. The middle pin has an inserting portion inserted into the chamber from a front of the chamber for electrically contacting with the power plug connector and a connecting portion exposed out of the chamber. The first shell has a soldering portion for being connected to ground. The second shell has a supporting plate for covering the rear surface of the insulating housing and being connected with the first shell. A middle of the supporting plate defines a window. A plurality of contacting pieces at intervals are extended towards one side from an edge of the window and extended into the chamber for abutting against the power plug connector.

As described above, the power jack connector is so designed that the electromagnetic interference signals generated between the power jack connector and the power plug connector can be completely dispersed out by means of the contacting pieces of the second shell electrically abutting against the power plug connector and the soldering portion of the first shell being connected to ground.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
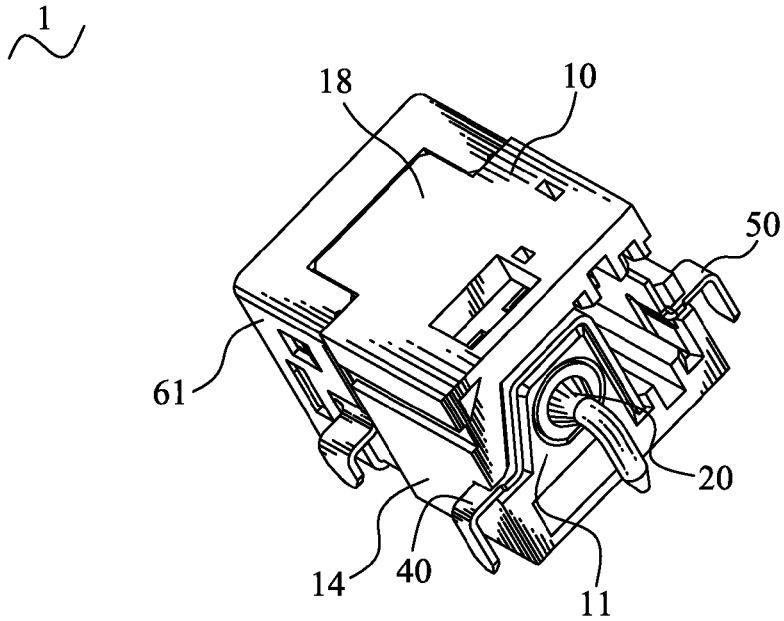
FIG. 1 is a perspective view of a power jack connector in accordance with the present invention.
Figure 2:
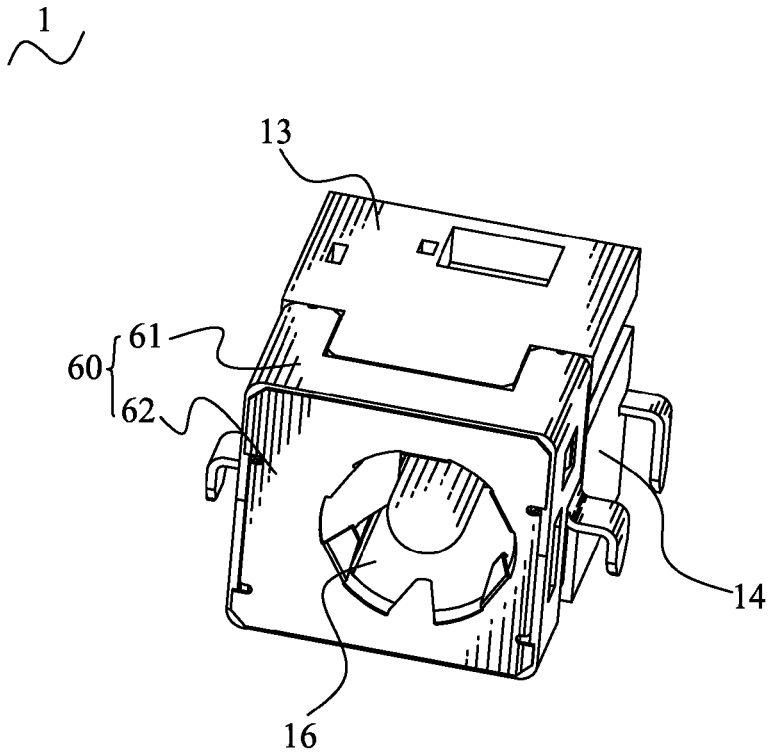
FIG. 2 is another perspective view of the power jack connector of FIG. 1.
Figure 3:
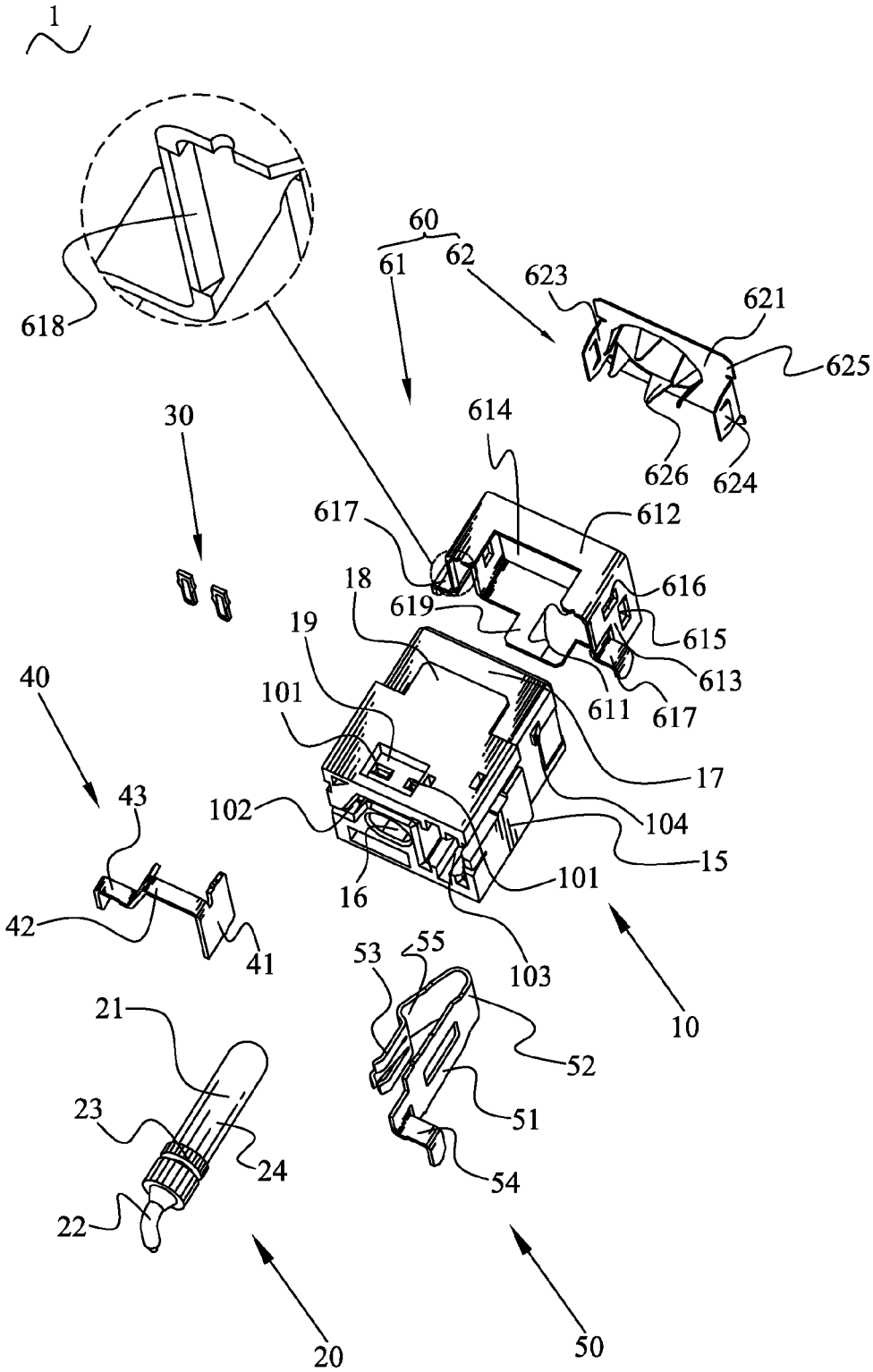
FIG. 3 is an exploded view of the power jack connector of FIG. 1.
Figure 4:
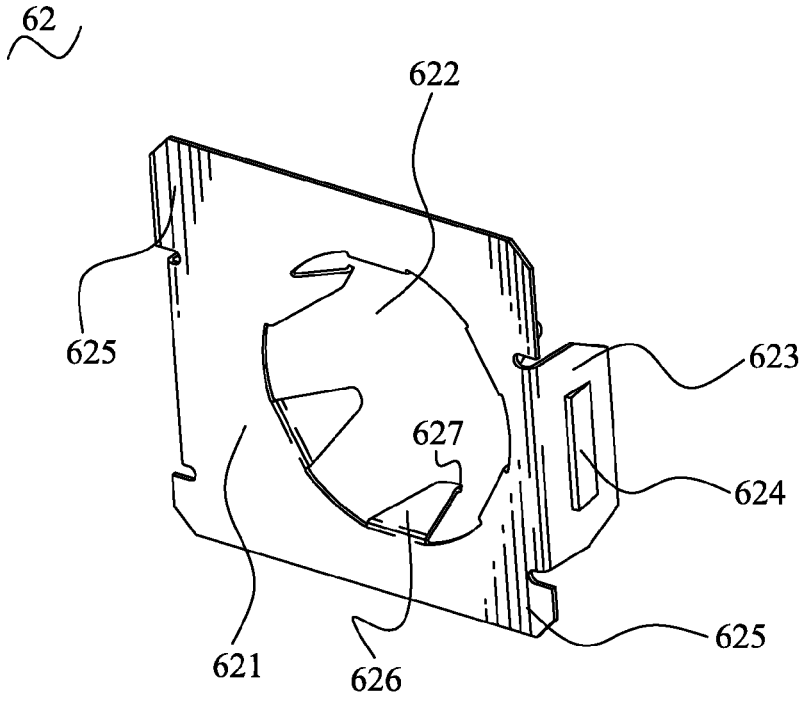
FIG. 4 is a perspective view of a fortified shell of the power jack connector of FIG. 1.

Referring to FIGS. 1-3, a power jack connector 1 according to the present invention is shown. The power jack connector 1 includes an insulating housing 10, a terminal group and a pair of latches 30 disposed in the insulating housing 10 respectively, and a grounding means 60 surrounding a rear end of the insulating housing 10.

Referring to FIGS. 1-3 and FIG. 6, the insulating housing 10 is of a substantial rectangular shape and defines a front surface 11, a rear surface 12 opposite to the front surface 11, a top surface 13, a first lateral surface 14 and a second lateral surface 15 opposite to the first lateral surface 14. A chamber 16, with a circular cross-section, is formed in the insulating housing 10 and longitudinally passes through middle portions of the front surface 11 and the rear surface 12 of the insulating housing 10 for receiving a corresponding power plug connector (not shown) therein. The rear end of the insulating housing 10 defines a substantially rectangular-ring shaped recess 17 passing through the rear surface 12 of the insulating housing 10. A middle front edge of a top of the recess 17 extends into the recess 17 to form a substantially rectangular holding block 18. A middle front edge of a bottom of the recess 17 extends into the recess 17 to form a pair of bar-shaped projections 106 spaced away from and paralleling to each other. The top surface 13 of the insulating housing 10 further defines a rectangular receiving cavity 19 in front of the holding block 18. Two portions of the receiving cavity 19 are further recessed downward to form a pair of fixing holes 101 communicating with the chamber 16 and spaced from each other. The insulating housing 10 further defines a locating groove 102 located at a top portion of the front surface 11 and adjacent to the first lateral surface 14. The locating groove 102 further passes through the first lateral surface 14. The front surface 11 further defines a positioning groove 103 located adjacent to the second lateral surface 15 and communicating with the locating groove 102. The positioning groove 103 further passes through the second lateral surface 15. Both the locating groove 102 and the positioning groove 103 communicate with the chamber 16. Two opposed sides of the recess 17 have portions protruded outward to form two second wedges 104.

Referring to FIG. 2 again, the terminal group includes a middle pin 20, a switch terminal 40 and a spring terminal 50. The middle pin 20 has a columniform-shaped inserting portion 21 extending longitudinally. A middle of one end of the inserting portion 21 extends along an extending direction of the inserting portion 21 and then bent perpendicularly to form a connecting portion 22. A portion of a peripheral surface 24 of the inserting portion 21 defines a ring-shaped fixing groove 23 circled therearound.

Referring to FIG. 3 again, the switch terminal 40 has a substantial rectangular contact plate 41 disposed vertically. A step-shaped connecting arm 42 is extended sideward from an edge of the contact plate 41. A tip end of the connecting arm 42 is bent perpendicularly to form a soldering tail 43 facing the contact plate 41. The spring terminal 50 has a rectangular fixing board 51 disposed vertically and extending longitudinally. A free end of the fixing board 51 extends rearward and then is bent frontward to form a U elastic portion 52. A contact portion 55 is formed on a tip end of the elastic portion 52 by shaping a curvature. A free end of the elastic portion 52 further extends to be close to the fixing board 51 to form a contact piece 53 facing the fixing board 51. An edge of the opposite end of the fixing board 51 is bent perpendicularly to form a soldering bar 54. The soldering bar 54 and the elastic portion 52 are located at two sides of the fixing board 51.

Figure 5:
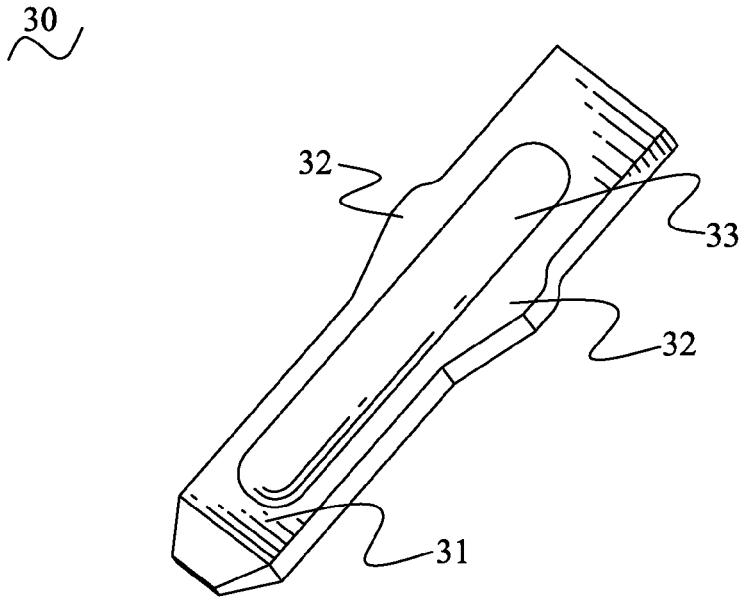
FIG. 5 is a perspective view of a latch of the power jack connector of FIG. 1.
Figure 6:
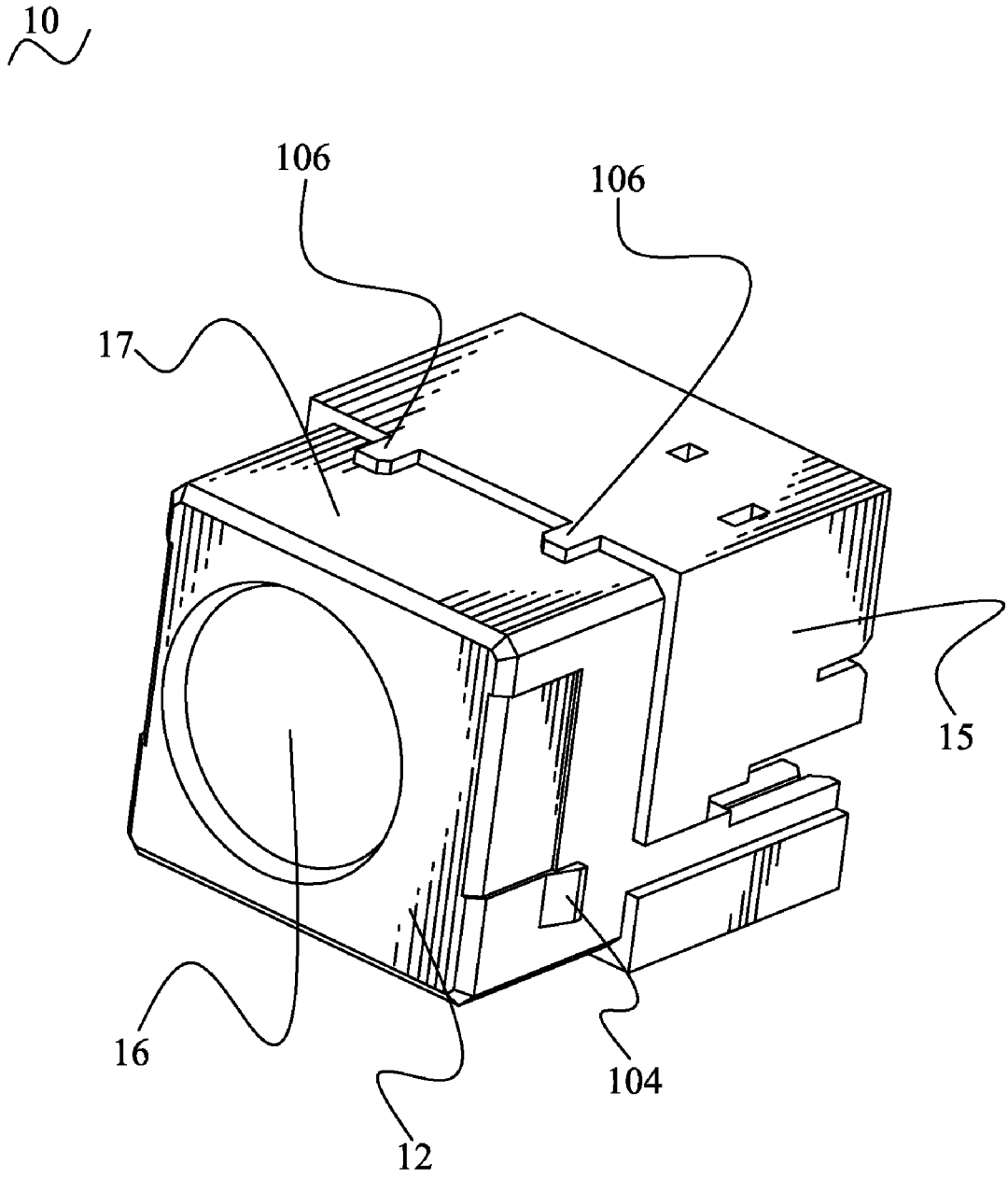
FIG. 6 is a perspective view of an insulating housing of the power jack connector of FIG. 1.

Referring to FIG. 2 and FIG. 5, each of the latches 30 has a substantial rectangular base plate 31. A pair of barbs 32 is protruded from two opposite side edges of the base plate 31, respectively. A side of the base plate 31 protrudes outward to form a holding rib 33 extending upward and downward.

Referring to FIG. 3 again, the grounding means 60 includes a main shell 61 and a fortified shell 62 connected with each other. The main shell 61 has a bottom plate 611, a top plate 612 opposite to the bottom plate 611, and two side plates 613 connecting the bottom plate 611 and the top plate 612. A middle front of the top plate 612 is cut off to form a gap 614 corresponding to the holding block 18 of the insulating housing 10. A middle of a front edge of the bottom plate 611 extends forward to form a bottom front board 619. Each of the side plates 613 defines a rectangular first engaging hole 615 and a rectangular second engaging hole 616 higher than and in front of the first engaging hole 615. A front of a bottom edge of the side plate 613 is bent perpendicularly and outward to form a soldering portion 617. A front edge of the side plate 613 further defines a slope 618 extending vertically.

Referring to FIG. 2 and FIG. 3, the fortified shell 62 has a rectangular supporting plate 621. The supporting plate 621 defines a circular window 622 passing through a middle thereof and corresponding to the chamber 16 of the insulating housing 10. Middles of two opposite side edges of the supporting plate 621 are bent perpendicularly to form a pair of elastic plates 623 facing each other. A portion of each of the elastic plates 623 protrudes outward to form a first wedge 624. The two opposite side edges of the supporting plate 621 further protrude oppositely to form two pairs of preventing pieces 625 which are located at two sides of the corresponding elastic plates 623, respectively. An edge of the window 622 extends towards the same direction as the elastic plate 623 to form a plurality of triangular contacting pieces 626 arranged at regular intervals along the edge of the window 622. The contacting piece 626 is tapered with a gradually from a root to a distal end thereof. The distal end of the contacting piece 626 is bent outward to form a smooth protecting portion 627.

Referring to FIGS. 1-6, in assembly, the middle pin 20 is inserted into the chamber 16 of the insulating housing 10 from a front of the chamber 16 with the inserting portion 21 being received in the chamber 16 for contacting the power plug connector and the connecting portion 22 being exposed out from the front surface 11 of the insulating housing 10. The switch terminal 40 is received in the locating groove 102 of the insulating housing with the connecting arm 42 and the contact plate 41 being received in the locating groove 102, and the soldering tail 43 being exposed out of the first lateral surface 14 of the insulating housing 10 for being soldered with a printed circuit board (not shown). The spring terminal 50 is received in the positioning groove 103 with the fixing board 51, the elastic portion 52 and the contact piece 53 being received in the positioning groove 103. The contact piece 53 contacts with the contact plate 41 of the switch terminal 40. The contact portion 55 further stretches into the chamber 16 for contacting the power plug connector and the soldering bar 54 is exposed out from the second lateral surface 15 of the insulating housing 10 for being soldered with the printed circuit board. Lower portions of the two latches 30 are positioned in the fixing groove 23 of the middle pin 20 and upper portions of the latches 30 are fixed in the corresponding fixing holes 101 of the insulating housing 10 so as to make the middle pin 20 received in the insulating housing 10 firmly. The barbs 32 abut against side surfaces of the fixing hole 101 for holding the latch 30 in the fixing hole 101 firmly. The holding rib 33 on the latch 30 is formed for ensuring the latch 30 fastened in the fixing hole 101 and the fixing groove 23.

The main shell 61 is mounted to the rear end of the insulating housing 10 through the slopes 618 for facilitating the main shell 61 being mounted to the insulating housing 10 and preventing the second wedges 104 of the insulating housing 10 from being damaged. The main shell 61 is positioned in the recess 17 of the insulating housing 10 with the holding block 18 being held in the gap 614 and the bottom front board 619 being abutted against between the two projections 106. The second wedges 104 are held in the corresponding second engaging holes 616 and the two side plates 613 engaged in the opposed sides of the recess 17 respectively. The soldering portions 617 are located at two sides of the insulating housing 10 for being soldered with the printed circuit board. The fortified shell 62 is mounted to the main shell 61 from rear to front for covering the rear surface 12 of the insulating housing 10. The elastic plates 623 abut against insides of the two side plates 613 of the main shell 61 with the first wedges 624 of the fortified shell 62 being buckled in the corresponding first engaging hole 615 of the main shell 61 so as to form a firm engagement between the main shell 61 and the fortified shell 62. The supporting plate 621 abuts against the rear surface 12 of the insulating housing 10 with the four preventing pieces 625 abutting against rear edges of the corresponding side plates 613 of the main shell 61 for preventing the supporting plate 621 of the fortified shell 62 from being fallen into the main shell 61. The contacting pieces 626 stretch into the chamber 16 with the middle pin 20 being surrounded by the contacting pieces 626.

In use, when the power plug connector is fully inserted into the chamber 16 of the power jack connector 1 from a rear of the chamber 16, the middle pin 20 electrically contacts with the power plug connector so as to form an electrical connection between the power jack connector 1 and the power plug connector. At the same time, the power plug connector is further electrically abutted against the contact portion 55 of the spring terminal 50 to make the contact piece 53 of the spring terminal 50 pushed outwards for being depart from the contact plate 41 of the switch terminal 40 by means of the elasticity of the elastic portion 52. The power plug connector is electrically abutted against by the contacting pieces 626 of the fortified shell 62 and the protecting portions 627 of the fortified shell 62 are designed to facilitate the power plug connector inserting into the power jack connector 1. The power jack connector 1 is designed to make the contacting pieces 626 of the fortified shell 62 electrically abut against the power plug connector and the main shell 61 electrically abuts against the fortified shell 62. The main shell 61 is connected to ground by means of the soldering portions 617. Therefore, the electromagnetic interference signals generated between the power jack connector 1 and the power plug connector can be completely dispersed out by means of the contacting pieces 626 of the fortified shell 62 and the soldering portions 617 of the main shell 61. So the power jack connector 1 of the present invention has a good effect of shielding electromagnetic interference and can ensure a steady signal transmission between the power jack connector 1 and the power plug connector.

As described above, the power jack connector 1 is so designed that the electromagnetic interference signals generated between the power jack connector 1 and the power plug connector can be completely dispersed out by means of the contacting pieces 626 of the fortified shell 62 electrically abutting against the power plug connector and the soldering portions 617 of the main shell 61 being connected to ground.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A power jack connector for receiving a power plug connector, comprising:

an insulating housing defining a chamber passing through a front surface and a rear surface thereof along an inserting direction of the power plug connector for receiving the power plug connector from a rear thereof;

a middle pin having an inserting portion inserted into the chamber from a front of the chamber for electrically contacting with the power plug connector and a connecting portion exposed out of the chamber;

a first shell surrounding a rear end of the insulating housing and having a soldering portion for being connected to ground; and a second shell having a supporting plate for covering the rear surface of the insulating housing and being connected with the first shell, a middle of the supporting plate defining a window, a plurality of contacting pieces at intervals being extended towards one side from an edge of the window and extended into the chamber;

wherein the first shell includes two opposed side plates, each of the side plates defines a first engaging hole, two opposed side edges of the supporting plate of the second shell have two facing elastic plates extended toward the same side as the contacting pieces for abutting against insides of the side plates of the first shell, and each of the elastic plates has a first wedge at an outside thereof for being buckled in the first engaging hole.

2. The power jack connector as claimed in claim 1, wherein each of the elastic plates is formed at a middle of the corresponding side edge of the supporting plate, and a pair of preventing pieces are protruded outwards from two sides of the side edge of the supporting plate to locate the elastic plate therebetween for abutting against rear edges of the corresponding side plate.

3. The power jack connector as claimed in claim 1, wherein two sides of the rear end of the insulating housing have two second wedges, and each of the side plates further defines a second engaging hole for engaging the corresponding second wedge.

4. The power jack connector as claimed in claim 1, further comprising a switch terminal and a spring terminal received in the insulating housing and connected with each other.

5. The power jack connector as claimed in claim 1, wherein the contacting piece is tapered gradually from a root to a distal end thereof.

6. The power jack connector as claimed in claim 5, wherein the distal end of the contacting piece is bent outward to form a smooth protecting portion.

7. The power jack connector as claimed in claim 6, wherein the chamber and the inserting portion of the middle pin are columniform-shaped, and the window is circular.

8. A power jack connector for receiving a power plug connector, comprising:

an insulating housing defining a chamber passing through a front surface and a rear surface thereof along an inserting direction of the power plug connector for receiving the power plug connector from a rear thereof;

a middle pin having an inserting portion inserted into the chamber from a front of the chamber for electrically contacting with the power plug connector and a connecting portion exposed out of the chamber;

a first shell surrounding a rear end of the insulating housing and having a soldering portion for being connected to ground; and a second shell having a supporting plate for covering the rear surface of the insulating housing and being connected with the first shell, a middle of the supporting plate defining a window, and a plurality of contacting pieces at intervals being extended towards one side from an edge of the window and extended into the chamber;

wherein the first shell has a top plate, a bottom plate and two side plates connecting the top and bottom plates, a front of the top plate defines a gap, a middle of a front of the bottom plate is extended to form a bottom front board, the rear end of the insulating housing defines a substantially rectangular-ring shaped recess for receiving the first shell, a front of a top of the rectangular-ring shaped recess has a holding block for engaging with the gap, and a front of a bottom of the rectangular-ring shaped recess has two projections spaced away from each other for abutting the bottom front board therebetween.

9. The power jack connector as claimed in claim 8, further comprising two latches, wherein the insulating housing defines two spaced fixing holes communicating with the chamber and penetrating through a top thereof, wherein a portion of a peripheral surface of the inserting portion of columniform-shape defines a ring-shaped fixing groove circled therearound, lower portions of the latches are positioned in the fixing groove, upper portions of the latches are fixed in the fixing holes.

10. The power jack connector as claimed in claim 9, wherein each of the latches includes a base plate, a pair of barbs is protruded from two opposite side edges of the base plate for abutting against side surfaces of the fixing hole.

11. The power jack connector as claimed in claim 9, wherein each of the latches includes a base plate, a holding rib is protruded from a side of the base plate and extends upward and downward for ensuring the latch fastened in the fixing hole and the fixing groove.

* * * * *